US006487826B1

(12) United States Patent
McCorsley et al.

(10) Patent No.: US 6,487,826 B1
(45) Date of Patent: Dec. 3, 2002

(54) MATERIAL FOR BUILDING VENTILATION SYSTEM

(76) Inventors: Curtis McCorsley, 33 Beaver Valley Rd., Asheville, NC (US) 28804; Jack Henderson, 335 Summit Rd., Springfield, PA (US) 19064

( * ) Notice: Subject to any disclaimer, the term of this patent is extended or adjusted under 35 U.S.C. 154(b) by 0 days.

(21) Appl. No.: 09/294,404

(22) Filed: Apr. 20, 1999

(51) Int. Cl.[7] ..... E04B 7/00
(52) U.S. Cl. ..... 52/408; 52/95; 52/309.1
(58) Field of Search ..... 52/95, 302.3, 408, 52/101, 302.1, 309.1

(56) References Cited

U.S. PATENT DOCUMENTS

| | | | | | |
|---|---|---|---|---|---|
| 4,212,692 | A | | 7/1980 | Rasen et al. | |
| 4,252,590 | A | * | 2/1981 | Rasen et al. | 156/167 |
| 4,315,392 | A | | 2/1982 | Sylvest | |
| 4,393,634 | A | * | 7/1983 | McDermott et al. | 52/309.1 |
| RE31,599 | E | | 6/1984 | Rasen et al. | |
| 4,530,193 | A | * | 7/1985 | Ochs | 52/408 |
| 4,689,258 | A | * | 8/1987 | Slosberg et al. | 428/141 |
| 4,805,367 | A | | 2/1989 | Kleckner | |
| 4,810,573 | A | * | 3/1989 | Harriett | 428/331 |
| 4,852,517 | A | * | 8/1989 | Smith et al. | 119/28.5 |
| 4,942,699 | A | | 6/1990 | Spinelli | |
| 4,996,812 | A | | 3/1991 | Venable | |
| 5,099,627 | A | | 3/1992 | Coulton et al. | |
| 5,238,450 | A | * | 8/1993 | Rotter | 454/260 |
| 5,573,844 | A | * | 11/1996 | Donovan et al. | 442/183 |
| 5,832,677 | A | * | 11/1998 | Kurttila | 52/95 |
| 6,086,755 | A | * | 7/2000 | Tepper | 210/150 |
| 6,296,912 | B1 | * | 10/2001 | Zickell | 428/40.1 |

FOREIGN PATENT DOCUMENTS

| | | |
|---|---|---|
| GB | 2186898 | 8/1987 |
| JP | 07-102487 | 10/1993 |

* cited by examiner

*Primary Examiner*—Carl D. Friedman
*Assistant Examiner*—Brian E. Glessner
(74) *Attorney, Agent, or Firm*—Oliff & Berridge, PLC

(57) ABSTRACT

A ventilation system and material therefor includes a passage beneath the shingle layer of the roof of a building. The passage leads from the exterior of the building to the interior of the attic of the building. The passage is plugged with an air permeable polymeric material to allow passage of air from the exterior of the building to the interior of the building, and vice versa. The polymeric material is preferably shaped with a tapered cross section.

8 Claims, 6 Drawing Sheets

MATERIAL FOR BUILDING VENTILATION SYSTEM

BACKGROUND OF THE INVENTION

1. Field of Invention

This invention relates to the ventilation of building structures. More particularly, this invention is directed to a system and material for improving ventilation within the attic areas of residential, light commercial, and other buildings.

2. Description of Related Art

Ventilation is conventionally provided in residential and light commercial buildings through the use of soffit vents. The soffit is the band of ceiling-like area covering the bottom of the roof overhang. A soffit vent is a strip vent or the like installed in the soffit to ventilate the attic and the roof to provide air circulation in this otherwise enclosed space. However, some buildings with soffit vents have ineffectual ventilation as a result of clogging of the vents. For example, clogging often results from insulation having been pushed into the eaves and covering the vent openings, preventing air from getting into or out of the building through the openings. Clogging of the vents can also occur when paint is applied to the vents and the secondary surrounding structure without ensuring that the paint does not dry clogging the vents.

Other conventional methods for supplying air to the attic include louvered vents or ridge vents located in the portion of the structure at or near the ridge of the roof, as well as gable vents and turbines located on the roof structure. Each of these approaches, however, does not provide optimal air ventilation in the attic. The louvered vents that are located near the top of the roof generally provide ventilation only to the top of the roof at the ridge line, and thus not to the entire attic. The turbines that are attached to the roof require both a hole in the shingles and the roof deck, thus increasing the chances of water penetration into the attic; furthermore, they require energy for operation.

Roof structures not providing adequate ventilation to the attic area are known to produce high temperatures in the attic during the summer months. This typically results in reduced shingle life and increased air conditioner usage, and associated costs.

Another problem with conventional ventilation systems is the formation of ice dams on roofs during winter months in geographic areas that receive heavy amounts of snow. A conventional roof allows snow to slide down the roof until the snow stacks up against the gutter. Heat within the attic, which is generally above the freezing point of water, allows melted snow to back-up on the roof, enabling the water to migrate under the edge of the shingle and onto the wood roof deck. This water may eventually deteriorate the deck structure and eventually work its way through the ceiling of the structure. Although some government authorities require the use of a plastic or metal snow shield to help alleviate this problem, such requirements are not universal. Furthermore, this problem can occur in other geographic areas under severe weather conditions.

U.S. Pat. No. 5,099,627 to Culton et al. discloses a ventilated roof construction that allows for air circulation beneath shingles to stall deterioration.

In other fields of art, materials are used that are composed of low density matted thermoplastic macro-filaments irregularly looped and intermingled in highly porous and/or open peak and valley, three-dimensional sheet structures. Such materials are disclosed, for example, in U.S. Pat. Nos. 4,212,692; 4,252,590; and 31,599; the entire contents of each of which are hereby incorporated herein by reference. One application of these materials has been as soil retention matting for use in the building industry.

SUMMARY OF THE INVENTION

A ventilation system for building structures provides a passage or passages from the exterior of the building to the interior of the attic area of the building. Each passage is filled with an air permeable solid material, preferably a low density air and, possibly, liquid permeable three-dimensional matrix of matted polymeric material. The air permeable material allows air to enter into and ventilate the attic of the building. The opening of each passage at the exterior of the building is preferably located near the eave of the roof structure, between the shingles and the roof deck or decking or sheathing and the opening preferably extends around the entire perimeter of the outer edge of the roof. A slot in the roof sheathing provides an air passage into the attic area. Optionally, a conventional opening is preferably located at the apex of the roof to provide in combination with the opening beneath the shingle, a ventilation system going from the lower part of the roof to the upper part of the roof. In warm weather, warm air will generally be ventilated out of the building through the top of the roof, with cooler air being pulled in from the lower part of the roof. In cooler weather, cool air will tend to move out of the lower areas of the roof. The air driving force within the attic may be the differential air temperature in the attic. A vent system will function more efficiently where there is a slight breeze creating a venturi. The present invention allows air to enter the attic at the opposite end from which one would normally expect to find the venturi (usually at the apex of the roof since air flow is the least restricted at this point). The system functions when an adequate air supply enters through the ventilation system of the invention to replace air being sucked out due to the pressure differential at the venturi. Also, the formation of ice dams at the base of the roof may be prevented.

The polymeric material layer is preferably shaped with a tapered cross section, with the wide area of cross section preferably located at or near the external opening of the passage. A protective layer preferably covers the polymeric material layer to protect against bugs from entering the system and/or to slow the velocity of air entering the system to prevent water from being driven under the shingle and into the slot.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

The present invention is directed to a ventilation system for use in buildings, and to a specially constructed material therefor. The specially constructed material provides an air permeable passageway from the exterior of a building into the interior of the roof area of the building. The ventilation system is suitable for use in residential, commercial and generally any other type of building that has an attic or an air space into which an airflow opening can be made in accordance with the present invention. The roof will preferably have at least some degree of slope to prevent water infiltration into the slot.

Figure 1:
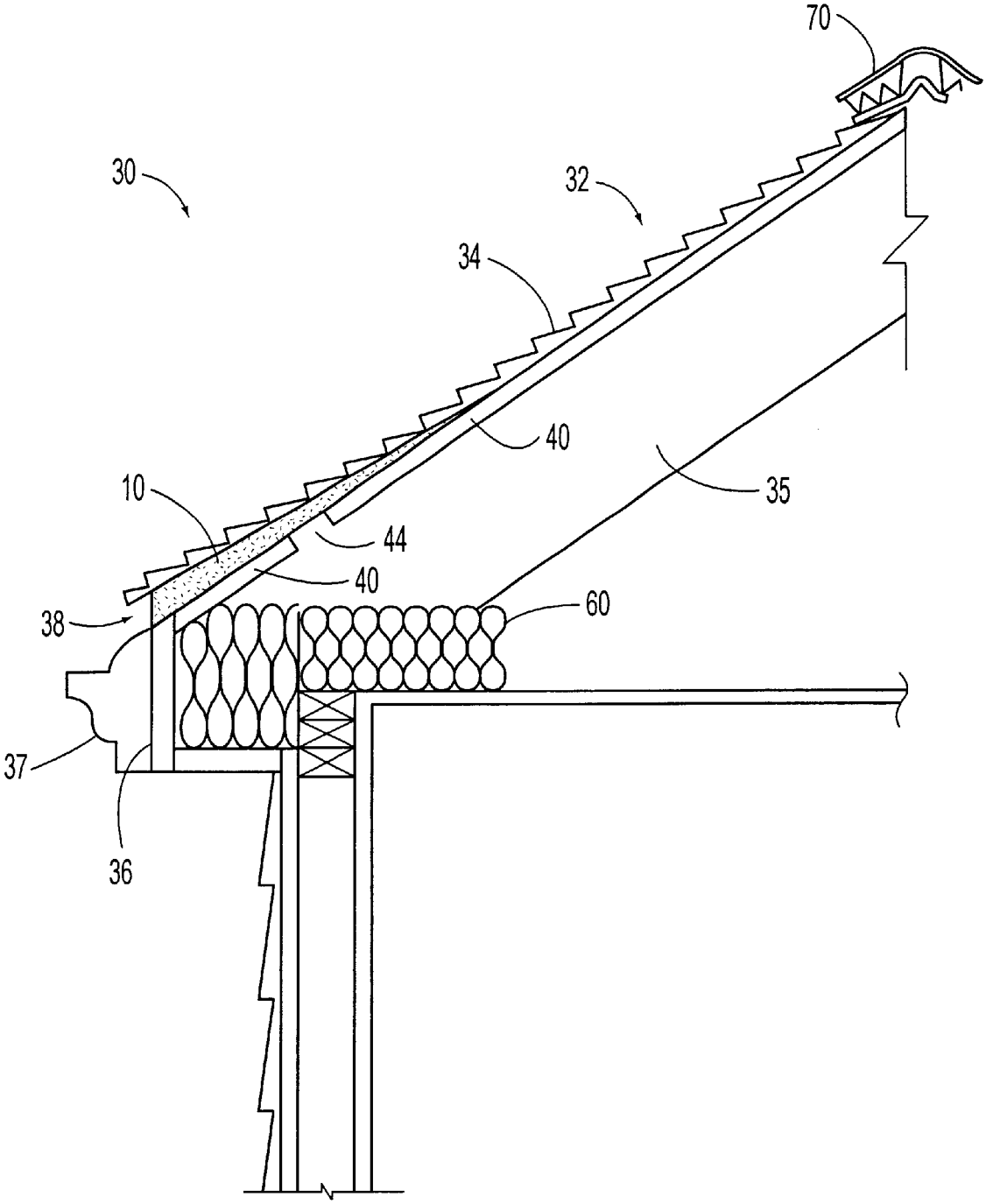
FIG. 1 is a cross-sectional view showing a portion of a residential home in which a first embodiment of the ventilation system in accordance with the present invention has been installed.

FIG. 1 shows an exemplary embodiment of the ventilation system for a building 30 having a roof 32. The roof is shown supported with roof sheathing or decking 40 over rafters 35. A slot or opening 44 is located through the roof decking 40. The slot 44, in a preferred embodiment, is an approximately one inch slot offset about six and one-half to seven and one-half inches from the end of the roof decking 40, adjacent to a gutter 37. The slot 44 preferably is installed to make a continuous opening along the bottom of the roof of the building. In one preferred embodiment, the slot 44 does not extend up the sides in the direction of the ridge. In other embodiments, a slot does extend up the sides in the direction of the ridge. Alternatively, a plurality of slots 44 can be periodically installed at spaced locations around the building to provide adequate ventilation. The slot is preferably located just above a fascia board 36.

The roof 32 may include a layer of shingles 34. The gutter 37 is adjacent to the fascia board 36 and is located a spaced distance under the shingles 34. An opening 38 is formed in the space between the shingles 34 and the gutter 37. The opening 38 extends between the shingles and the roof decking 40 least to the slot 44, and preferably a short distance beyond the slot 44. An air ventilation passageway is formed from the exterior of the building to the interior of the building by the combination of the opening 38 and the slot 44.

An air permeable layer or plug 10 fills the passageway formed between opening 38 and slot 44 to provide a plugged ventilation pathway. The air permeable layer 10 provides a flowpath or flowpaths for air to either enter or exit the attic area of the building 30. Of course, because the plug preferably fully occupies the opening, an air passageway is provided, but the opening does not provide an area for insects or other materials to enter the attic space. Alternatively, the plug 10 may be composed of a material containing air passage tunnels. This alternative plug could be, for example, an extruded or assembled article.

A layer of conventional insulation 60 is also shown, although the presence or absence of insulation is not necessary as part of the present invention. Likewise, although the roof system has been described above as containing all of the various components, it will be readily apparent that all of those components are not necessary in all embodiments of the present invention, and the present invention can be applied to a wide variety of roofing systems.

In order to create a vertical draft, it is preferable to provide a secondary opening or openings, preferably at a height different from the altitude of the passageway formed by opening 38 and slot 44 and plugged by layer 10. One suitable type of secondary opening is a "ridge vent". One example of a preferred secondary opening, as illustrated in FIG. 1, is a conventional vent 70, such as, preferably, a ROLL VENT®, provided at or near the apex of the roofing. For optimal results, a vent will preferably be located at or near the highest point in the attic, since that will be the location of the lightest, and thus warmest, air. This vent is preferably a ridge vent. To allow air to passively exit the attic through the ridge vent, it is desirable to supply a cooler air at the lowest point in the attic space. This can be accomplished using a soffit vent or using the under the shingle vent of this invention located at the base of the roof line. Using such an arrangement, optimal air turnover is achieved as the cool air is heated when heat is transferred from the hot exterior of the roof. One preferred vent is illustrated and described in U.S. Pat. No. 4,942,699, the entire contents of which are hereby incorporated by reference herein.

Figure 2:
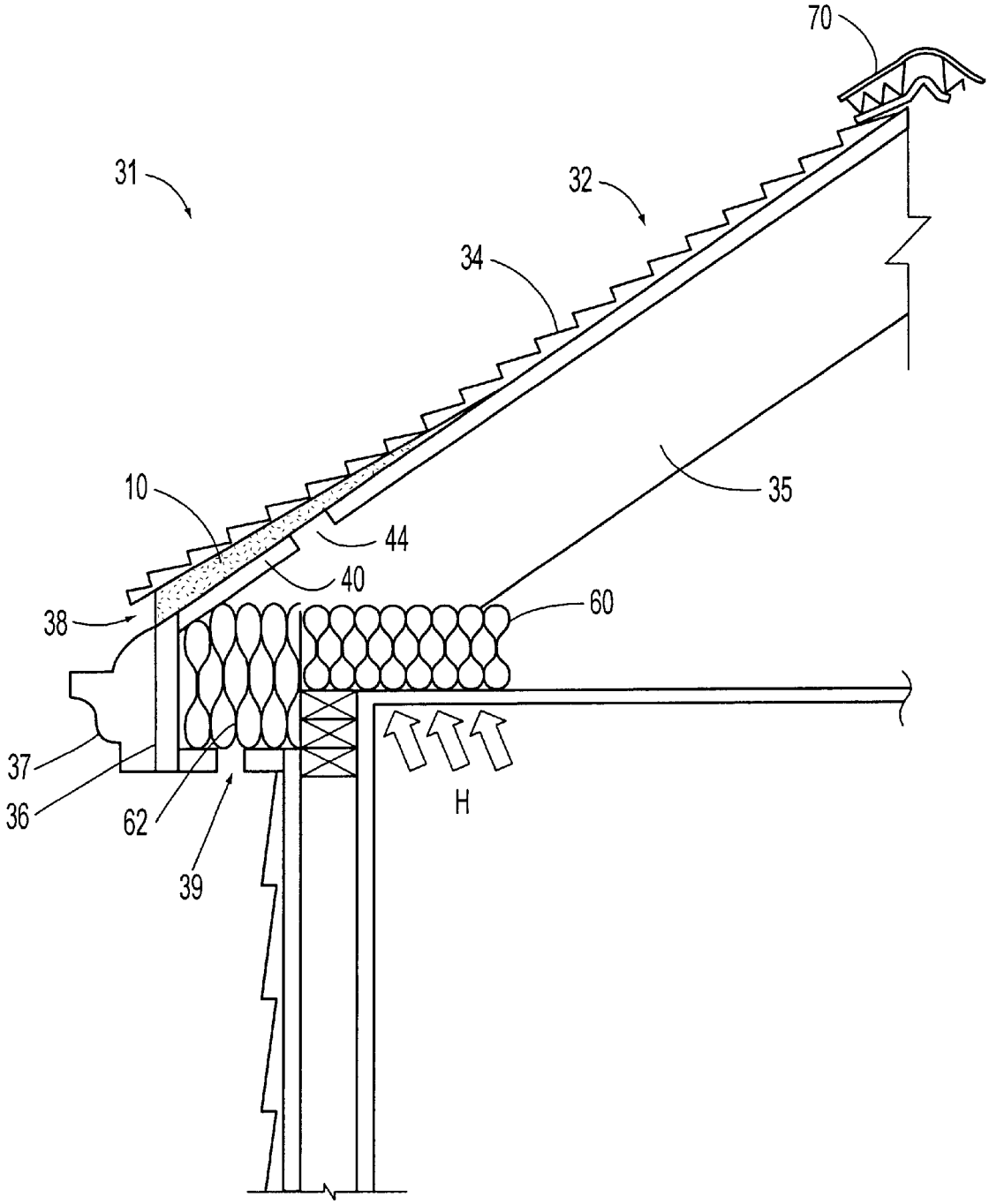
FIG. 2 is a cross sectional view showing a portion of a residential home in which a second embodiment of the ventilation system in accordance with the present invention has been installed.

The present invention may be installed on new buildings, or retrofitted into existing buildings. In FIG. 2, the ventilation system of the present invention is shown installed on a building 31, which includes a conventional soffit vent 39. Although only one soffit vent 39 is shown, many may exist at spaced locations around the periphery of the building. The common problem of insulation 62 getting pushed adjacent to, and blocking the air flow through, the soffit vent 39 is represented. The present invention provides an air passageway to the attic even after the soffit opening has been blocked.

Heat, represented by H and the double arrows, tends to rise within the building, and move by conduction or convention into the attic area. With the system of the present invention, in the summer months cooler air will be pulled in through the opening 38 (and the soffits if they are not blocked) and warmer air will exit the building through the ridge vent 70.

Figure 3:
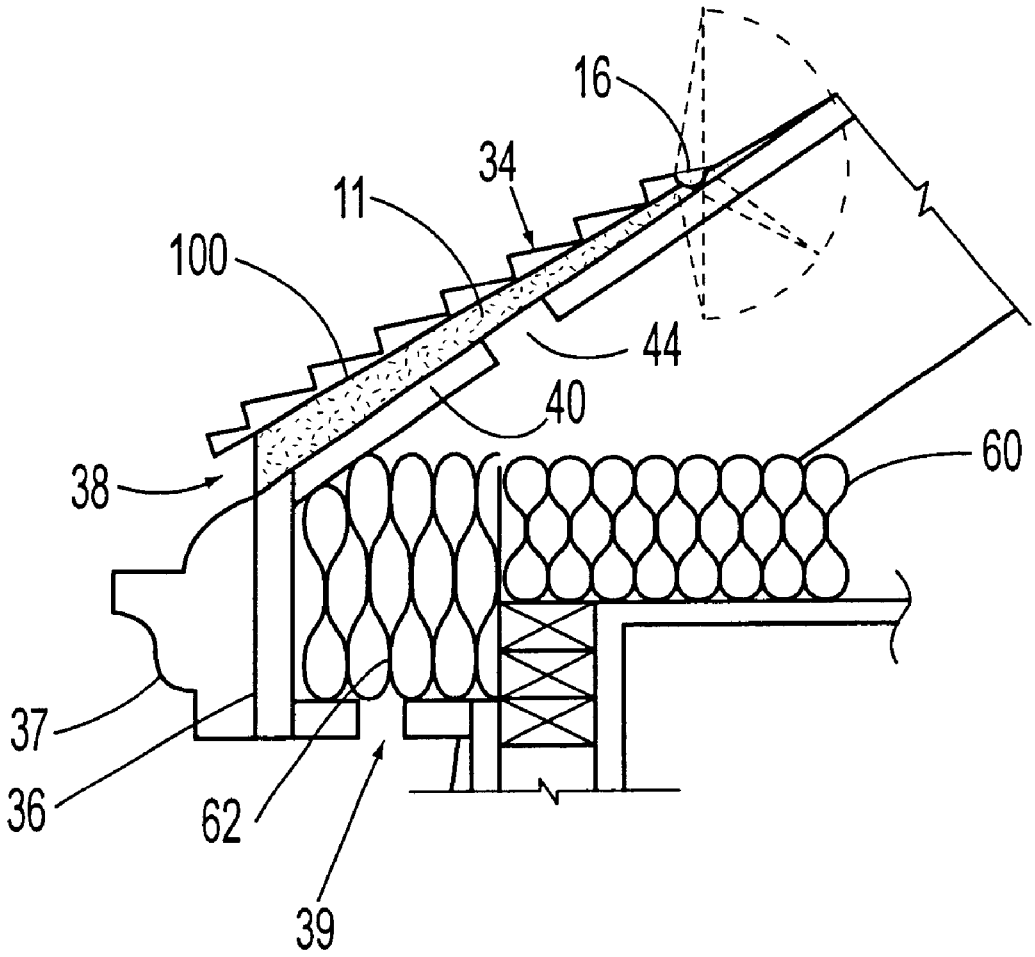
FIG. 3 is an enlarged view of a portion of a residential home featuring a ventilation system in accordance with the present invention.
Figure 4:
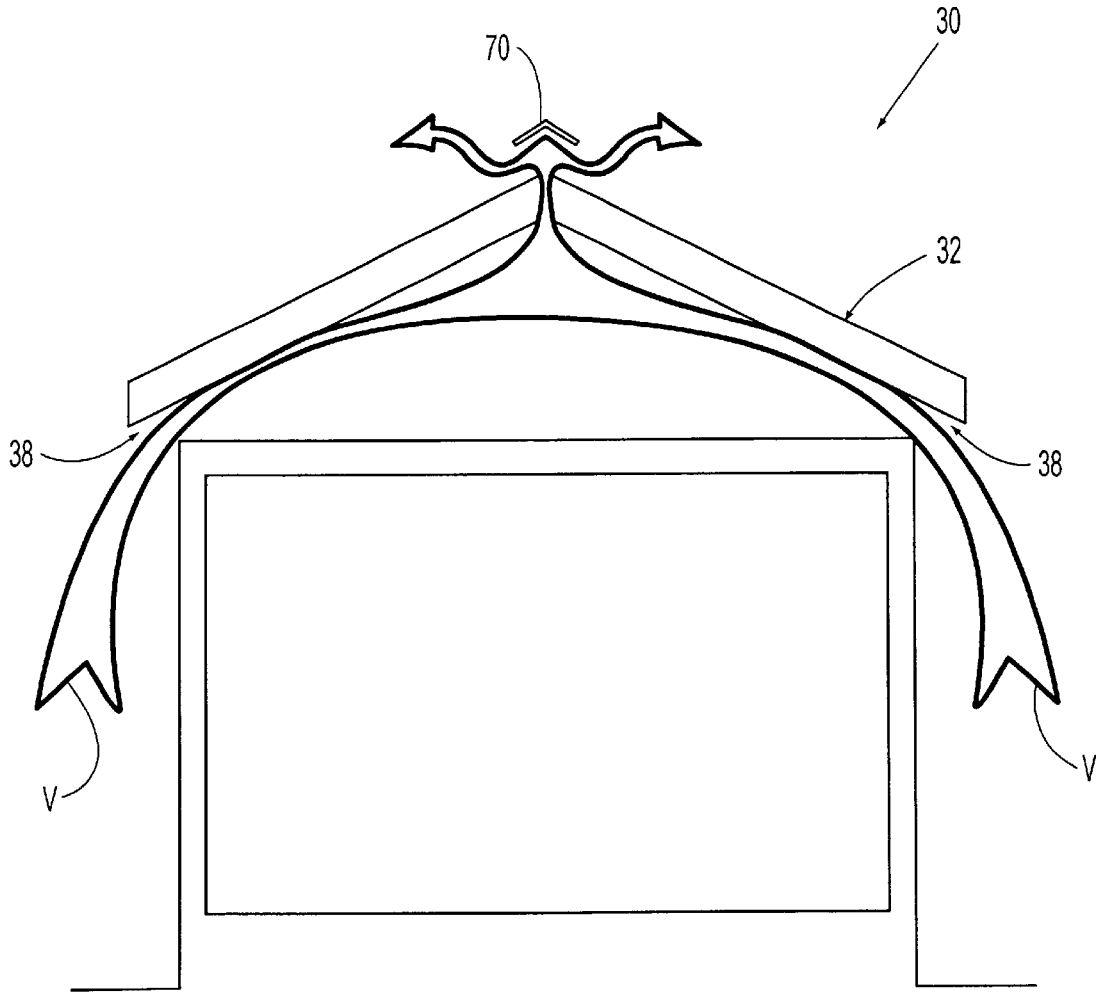
FIG. 4 is an illustration of an embodiment of the ventilation system of the present invention.

In FIG. 3, another embodiment of the ventilation system of the present invention is shown installed on a building that includes a conventional soffit vent 39. In this embodiment, a layer 100 includes an optional hinge 16 for adaptability for use in both initial roofing installations and for re-roofing installations or for buildings that also require an ice dam system FIG. 4 provides a schematic illustration of the ventilation system of the present invention as it would tend to operate during warm weather. Ventilation pathways, represented by V, bring cooler air into the building 30 through openings 38. This cooler air pushes warmer air out through the ridge vent 70 at or near the apex of the roof 32.

Figure 5:
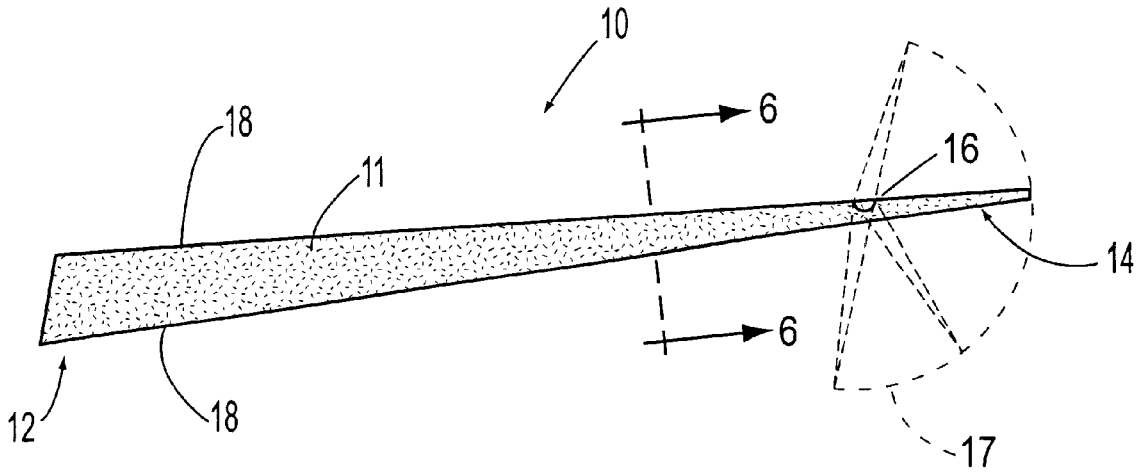
FIG. 5 is a cross-sectional view of a layer of material in accordance with an embodiment of the present invention preferably used as part of the ventilation system of the present invention.

A preferred embodiment of the air permeable plug 10 is shown in FIG. 5. The plug 10 is preferably shaped with a tapered cross section from a wide end 12 to a thin end 14. The tapered cross section provides a wedge shape, which enables the plug 10 to be installed easier between the shingles 34 and the roof decking 40. When installed in a roof, the wider end 12 preferably faces toward the outside of the house in order to provide a relatively large passage for venting air. The thinner end, which extends up the roof, provides a flush installation between the shingles 34 and the decking 40. Installation in this manner also tends to provide a more even and smooth slope to the roof line. While it is preferred that the tapered cross section plug 10 be used in the invention, plugs having different cross sections may alternatively be used. For example, a plug having a rectangular cross section could be used. However, an air space may be formed between the shingles 34 and roof decking 40 after the end of the rectangular embodiment plug extending up along the roof. Also, if the product has a sharp corner, it may cause the shingle to crack. Thus rounded comers are preferred. Other possible shapes include various combinations of flat and tapered sections.

The wedge shaped cross section preferably has a thickness at the wide end 12 of about 0.2 to about 1.5 inches, and more preferably between about 0.625 and about 0.75 inches, and a thickness at the thin end 14 of about 0.0 inches to about 0.25 inches, and preferably about 0.125 inches. The material preferably has a weight between about 5 to about 25 oz./sq. yd. and, more preferably, about 7.7 oz./sq. yd. to about 11.8 oz./sq. yd.

The length of the layer 10 from wide end 12 to thin end 14, in a most preferred embodiment, is about eleven and one-half or about twelve inches, although any effective length or lengths may be used. For example, the layer 10 could be provided in a number of lengths ranging from ten inches to forty inches, such as twelve inches, twenty-four inches, and thirty-six inches, and in models with and without the hinge 16 feature. Also, the layer 10 could be provided in long sections of different lengths or, for example, in specified lengths of, for example, 8 feet, 10 feet, 12 feet and 20 feet.

The material 11 used for the plug 10 may be any air permeable material. Preferably the material 11 is an air and liquid water permeable, three-dimensional matrix of thermoplastic micro-filaments irregularly looped and intermingled in a highly porous or open, three-dimensional sheet structure. Examples of three-dimensional matrix materials that may be utilized for the layer include, but are not limited to, ENKAMAT® and ENKADRAIN®, which are manufactured by Akzo Nobel Geosynthetics Company of Enka, N.C. U.S. Pat. Nos. 4,212,692; 4,252,590; and 31,599, the entire contents of each of which are hereby incorporated herein by reference, disclose three-dimensional matrices that may be used for the layer of air and liquid water permeable three-dimensional matrix of the present invention. Such materials achieve a hollow space or proportion of voids of more than 95%, compared to other mattings that have a hollow space reaching a maximum of about 91 to 92%. Such materials also have a high transverse strength of at least 600 N/m, or even at least 1,000 N/m. Especially preferred is a specially constructed wedge shaped construction of ENKAMAT® material.

The preferred materials for the material 11 are three-dimensional matrices of polymeric material including but not limited to polystyrene, polypropylene, polyethylene, for example high density polyethylene, polyamides such as nylon 6, or other polymeric material and blends or copolymers thereof. In one exemplary embodiment, heavy nylon monofilaments fused at their intersections are used. About 95% of the geomatrix is open. In the exemplary embodiment, the polymeric material is preferably nylon 6 containing about 2% carbon black.

As shown in both FIGS. 3 and 5, the layer 10 may have the optional hinge 16 described above.

The material 11 may have a "peak and valley" configuration on at least one face.

Figure 6:
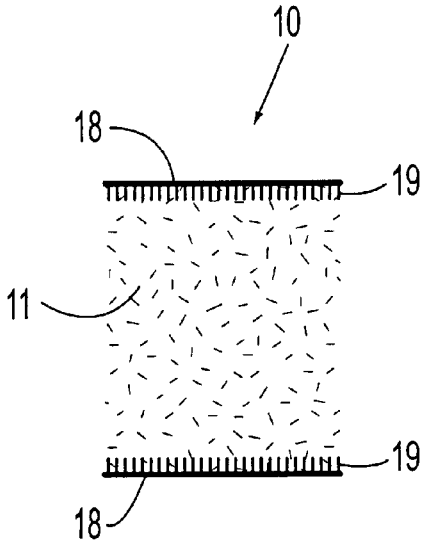
FIG. 6 is a cross-sectional view of the layer of material taken from perspective 6—6 of FIG. 5, all in accordance with the present invention.

In preferred embodiments of the present invention, the plug 10 comprises a core material which may be coated or contained within a covering material. As best seen in FIG. 6, a fabric layer 18 is preferably adhered to the material layer 11 so as to form the plug 10. The fabric layer may be simply wrapped around the material 11, or optionally, the fabric layer 18 can be adhered to the material 11 by means of an adhesive layer 19 or the equivalent. The fabric layer 18 preferably encloses at least the wide end 12, that is the end directly exposed to the outside environment, to prevent wind driven water, insects and debris from penetrating into the air permeable membrane 11, while providing adequate ventilation. Colback® is an example of a suitable material that may be used for the fabric layer 18, although any suitable material may be used so long as it prevents water, insects and debris from penetrating, while allowing air to pass through. A screen or screening material that keeps insects and wind driven rain out is preferred. A bicomponent screening material composed of nylon and polyester may be used.

Figure 7:
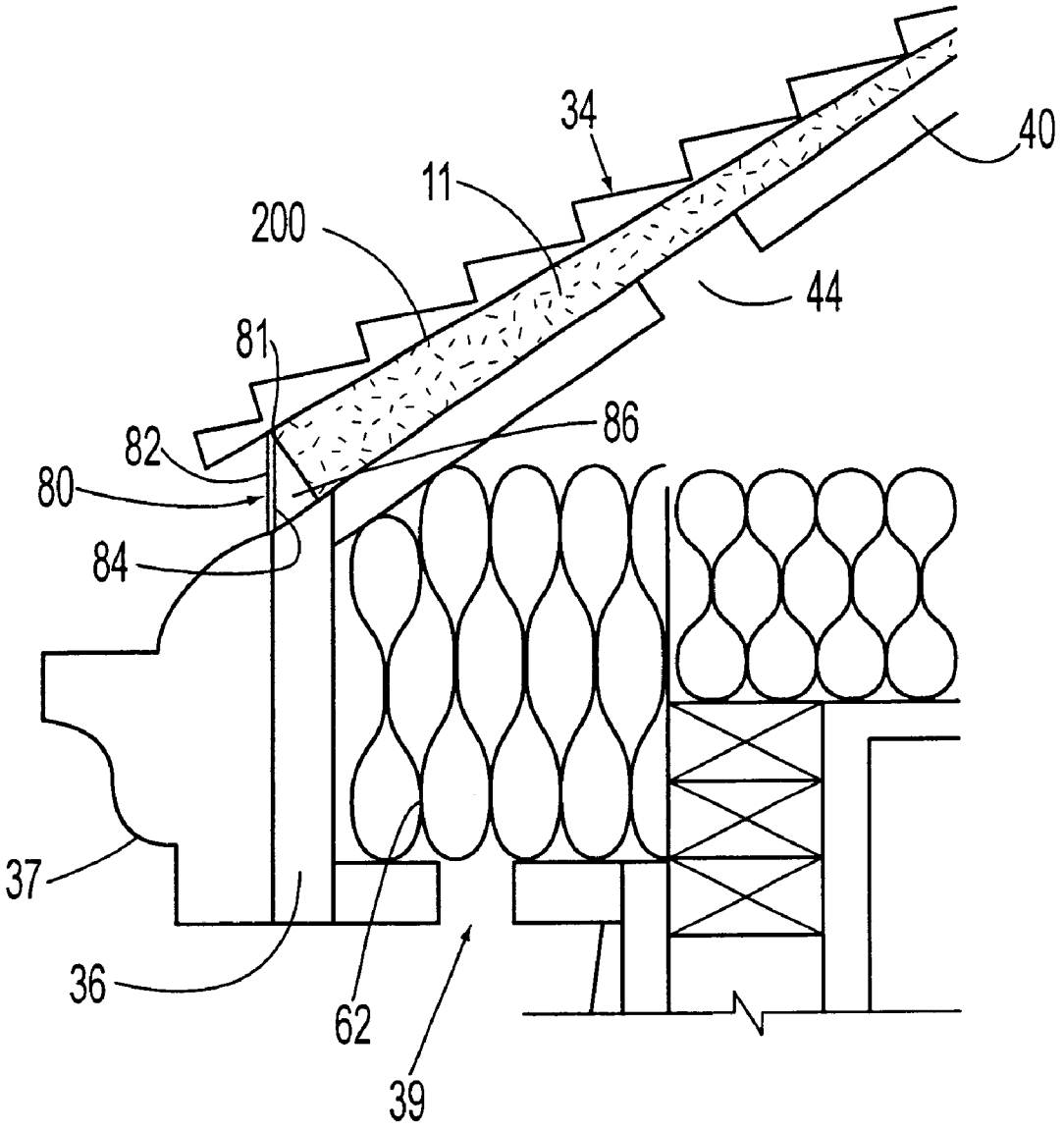
FIG. 7 is an enlarged view of a portion of a residential home featuring a ventilation system in accordance with the present invention.

In FIG. 7, another embodiment of the ventilation system is shown with an air permeable layer 200 that includes an overhanging end flap 80. The end flap 80 is preferably composed of a layer 84 of a thin weight fabric bonded to a layer 82 of rigid material. The rigid material 82 is preferably the same material used for the air permeable layer 200. The end flap 80 is preferably affixed to the layer 200 at a point 81 forming an angle a which is preferably between about ten and fifty degrees, and more preferably about thirty degrees. An open area 86 is created between the flap 80 and the layer 200. The flap 80 is effective as screen to prevent insects and large amounts of water from reaching the layer 200. The lower end of the flap 80 can be installed such that it abuts the fascia board creating a seal.

An advantage of embodiments of the present invention is that the roof shingles are not in contact with the roof deck in the critical area near the edge of the roof, around the gutter. This space between the shingle and the roof deck allows the outside air to circulate under the shingle, keeping the shingle temperature at ambient.

While the invention has been illustrated with one opening under the eaves for ventilation, the opening preferably extends along the entire length of each lower edge of the roof line. Alternatively, spaced openings of shorter lengths can be used to provide necessary ventilation. Also alternatively, the opening can extend around the entire periphery of the roof or at spaced locations around the periphery of the roof. Installation of the ventilation system of the present invention does not require any holes to be made through the shingles.

In an alternative arrangement, a plurality of openings may be used to provide an adequate air flow throughout the attic area. The use of any number of openings is within the scope of the invention. Similarly, other changes and embodiments of the invention are possible and the scope of the invention should be considered to encompass all possible embodiments of the invention, and any and all equivalents thereof.

What is claimed is:

1. An article of manufacture, comprising a layer of matting composed of an air and liquid water permeable three-dimensional matrix of polymeric material, said layer having a tapered thickness.

2. The article of claim 1, wherein a wide end of the tapered thickness at least about 0.75 inches and a thin end of said tapered thickness is at most about 0.25 inches.

3. The article of claim 1, further comprising a screening layer, adjacent to or affixed to a portion of the polymeric material layer.

4. The article of claim 3, wherein said screening layer restricts insects or water from entering the polymeric material layer.

5. The article of claim 3, wherein said screening layer comprises a bicomponent material composed of nylon and polyester.

6. The article of claim 1, wherein more than 91% of the matrix is open space.

7. The article of claim 1, wherein the matting has a transverse strength of at least 600 N/m.

8. The article of claim 1, wherein the matting has a transverse strength of at least 1000 N/m.

* * * * *

UNITED STATES PATENT AND TRADEMARK OFFICE

CERTIFICATE OF CORRECTION

PATENT NO. : 6,487,826 B1
DATED : December 3, 2002
INVENTOR(S) : Curtis McCorsley and Jack Henderson It is certified that error appears in the above-identified patent and that said Letters Patent is hereby corrected as shown below:

Column 2,
Line 2, “31,599” should read -- RE 31,599 --.

Column 3,
Line 45, “40 least” should read -- 40 at least --.

Column 4,
Lines 32-33, “convention” should read -- convection --.

Column 5,
Line 32, “31,599” should read -- RE 31,599 --.

Column 6,
Line 16, “angle a” should read -- angle α --.

Signed and Sealed this

Eighth Day of April, 2003

JAMES E. ROGAN
*Director of the United States Patent and Trademark Office*